United States Patent [19]

Vanderzanden

[11] Patent Number: 4,847,237

[45] Date of Patent: Jul. 11, 1989

[54] THERMAL MASS TRANSFER IMAGING SYSTEM

[75] Inventor: John W. Vanderzanden, St. Paul, Minn.

[73] Assignee: Minnesota Mining and Manufacturing Company, St. Paul, Minn.

[21] Appl. No.: 66,183

[22] Filed: Jun. 25, 1987

[51] Int. Cl.[4] ..... B41M 5/26

[52] U.S. Cl. ..... 503/227; 428/212; 428/337; 428/480; 428/483; 428/521; 428/522; 428/913; 428/914

[58] Field of Search ..... 428/195, 484, 488.1, 428/488.4, 913, 914, 40, 212, 337, 480, 483, 521, 522; 503/227

[56] References Cited

U.S. PATENT DOCUMENTS

| | | | |
|---|---|---|---|
| 4,251,276 | 2/1981 | Ferree, Jr et al. | 106/27 |
| 4,503,095 | 3/1985 | Seto et al. | 427/265 |
| 4,572,684 | 2/1986 | Sato et al. | 400/240.4 |
| 4,651,177 | 3/1987 | Morishita et al. | 503/227 |
| 4,686,549 | 8/1987 | Williams et al. | 503/227 |

FOREIGN PATENT DOCUMENTS

| | | | |
|---|---|---|---|
| 0194860 | 9/1986 | European Pat. Off. | 428/488.4 |

OTHER PUBLICATIONS

"High-Speed Thermal Ink-Transfer Recording and Its Application", T. Ohno, M. Mizuguchi, Y. Yamaguchi, T. Inoue, T. Ohzeki, and M. Nagashima, Journal of Applied Photographic Engineering, Vol. 7, No. 6, December 1981.

"Color Thermal Ink-Transfer Imaging", J. Ohya and Y. Tokunaga, IEEE Transactions on Electron Devices, Vol. ED-31, No. 9, September 1984.

"Trends in Color Thermal Transfer Printer Development and Technology", S. Hamada, Office Equipment and Products, February 1986.

"A Basic Study of Thermal-Transfer Printing for Improvement of Print Quality", S. Ando and H. Ogata, Proceedings of the SID, vol. 27/1, 1986.

"Thermal Ink-Transfer Imaging", Y. Tokunaga and K. Sugiyama, IEEE Transactions on Electron Devices, vol. ED-27, No. 1, Jan. 1980.

"N.I.P. on Plain Paper by Thermographic Ribbon", F. Knirsch, Advances in Non-Impact Printing Technologies for Computer and Office Applications, Joseph Gaynor ed., The Society of Photographic Scientists and Engineers, Proceedings of the First International Congress (1981), pp. 921-937.

*Primary Examiner*—Bruce H. Hess

*Attorney, Agent, or Firm*—Donald M. Sell; Walter N. Kirn; David L. Weinstein

[57] ABSTRACT

Kit for thermal mass transfer printing comprising (1) a donor sheet having a backing bearing an image donating layer on at least one major surface thereof, and (2) a receptor sheet having a transparent backing bearing a transparent image receptive layer on at least one major surface thereof.

The image donating layer does not contain wax or other hazy, opaque, or nonhomogenous materials. Colors are imparted to the image donating layer by means of dyes or dispersed transparent pigments that exhibit transparency in the particular binders used. While other thermal mass transfer systems are limited to melting or softening of the image donating layer only, the system of the present invention can also involve softening of the image receptive layer only, or softening of both image donating layer and image receptive layer.

15 Claims, 1 Drawing Sheet

THERMAL MASS TRANSFER IMAGING SYSTEM

FIELD OF THE INVENTION

This invention relates to thermal mass transfer printing, i.e., an imaging process which involves imagewise application of heat to transfer an image donating layer from a donor sheet to an image receiving layer on a receptor sheet.

DISCUSSION OF THE PRIOR ART

It is well-known that there is a fundamental difference between thermal mass transfer color printing on a paper substrate, where the printed image is viewed by reflected light, and thermal mass transfer color imaging on a transparent polymeric substrate, where the image is viewed by transmitted light, as in overhead projection. In the case of printing on opaque media such as paper, the image need not be transparent; accordingly, the use of opaque, reflecting pigments is permissible, and may even enhance image appearance. In the case of transparent polymeric films for providing colored images for overhead projection, it is vital that the image be transparent, since viewing is by means of transmitted light. Opaque pigments, and foreign particles, such as wax crystals, which scatter light, are therefore undesirable for imaging transparency films. While it is possible to form colored images on transparent polymeric film by means of donor materials containing wax and pigments (see, for example, U.S. Pat. No. 4,572,584), such images may be undesirable for viewing upon projection, even though they may look quite satisfactory when viewed directly. Upon projection, many of the colors appear dull and muddy, due to light loss resulting from the haze and partial opacity of the donor material. Some colors may even project as completely different hues from those seen when the same image is viewed by reflected light.

While melting of the image donating layer has proven to be a satisfactory method of image transfer, it suffers from certain disadvantages. When printing onto very porous paper, the melted donor material may be absorbed into the paper so deeply that the image density at the surface is reduced to unacceptably low levels. Further, the images produced by certain wax donors tend to be soft and easily scratched. In an effort to overcome these difficulties, Ando and Ogata (PROCEEDINGS OF THE SID, Vol. 27/1) developed a donor system called Solid Ink Releasing Technology (SIRT). SIRT uses a two layer donor, with the outer, or ink layer, providing the image, and the inner, or release layer, melting in an imagewise manner similar to the previously mentioned wax donors. The release layer is composed primarily of wax and ethylene vinyl acetate. Because the adhesion of the donor to the paper depends upon the adhesive properties of the ink layer, since it is the ink layer that contacts the paper during imaging, the ink layer is formulated to soften at imaging temperatures and adhere well to paper. This system still uses the melting of wax as the means of imagewise transfer; consequently the optical problems mentioned above are still present.

In the case where a monochrome black image is being printed onto a transparent polymeric film for the purpose of projection, color shift and dullness problems do not arise, because when a black image is viewed in the transmission mode, the effect of opacity and scattering results in a darkening of the image, thereby adding optical density to the black image, which is already the desired color. Accordingly, the existing conventional donor materials containing wax and pigment that are currently available for thermal mass transfer printers can produce satisfactory images on transparent media only when the color thereof is not critical.

SUMMARY OF THE INVENTION

This invention provides a donor sheet having a backing 12 bearing an image donating layer on at least one major surface thereof and a receptor sheet having a transparent backing bearing a transparent image receptive layer on at least one major surface thereof for use in making imaged transparent polymeric films by means of thermal mass transfer printing. The image donating layer does not contain wax or other hazy, opaque, or nonhomogenous materials. Colors are imparted to the image donating layer by means of dyes or dispersed transparent pigments that exhibit transparency in the particular binders used. The image receptive layer is formulated to promote thermally activated adhesion between the material of the image donating layer and the image receptive layer in imaged areas. While other thermal mass transfer systems are limited to melting or softening of the image donating layer only, the system of the present invention can also involve softening of the image receptive layer only, or softening of both image donating layer and image receptive layer. The thermal softening behavior required of the materials of the image donating layer and the image receptive layer are interdependent, in that a lower softening temperature of the material of the donating layer can allow the softening temperature of the material of the receptive layer to be somewhat higher. More specifically, if the softening temperature of the material of the image receptive layer is at or below 105° C., then the softening temperature of the material of the image donating layer can be as high as 150° C. However, if the softening temperature of the material of the image receptive layer is above 105° C., then the softening temperature of the material of the image donating layer must be restricted to 105° C. or less. Finally, the softening temperature of the material of the image receptive layer cannot be above about 185° C., regardless of the value of softening temperature of the material of the image donating layer. There is also a lower limit on the softening temperature of the material of the image donating layer of about 60° C., which prevents unintended imaging in non-imaged areas. In addition to the restrictions on softening temperature, the glass transition temperature of the material of the image receptive layer is also of significance and must be restricted to values below about 70° C. for satisfactory operation of the invention. Additionally, the image donating layer and the image receptive layer must be formulated to have surface energies which allow sufficient affinity between material of the image donating layer and the image receptive layer to assure complete and reliable image transfer at normal paper-printing speeds in commercially available thermal printers.

The present invention provides thermal mass transfer donor-receptor combinations that are capable of producing transparent images having clear, vivid colors when viewed in the projection mode. The present invention eliminates waxes and other haze producing ingredients from the donor formulation without degrading the desirable imaging properties of the system, particularly the speed at which the material can be run in commercially available thermal printers.

DETAILED DESCRIPTION OF INVENTION

Figure 1:
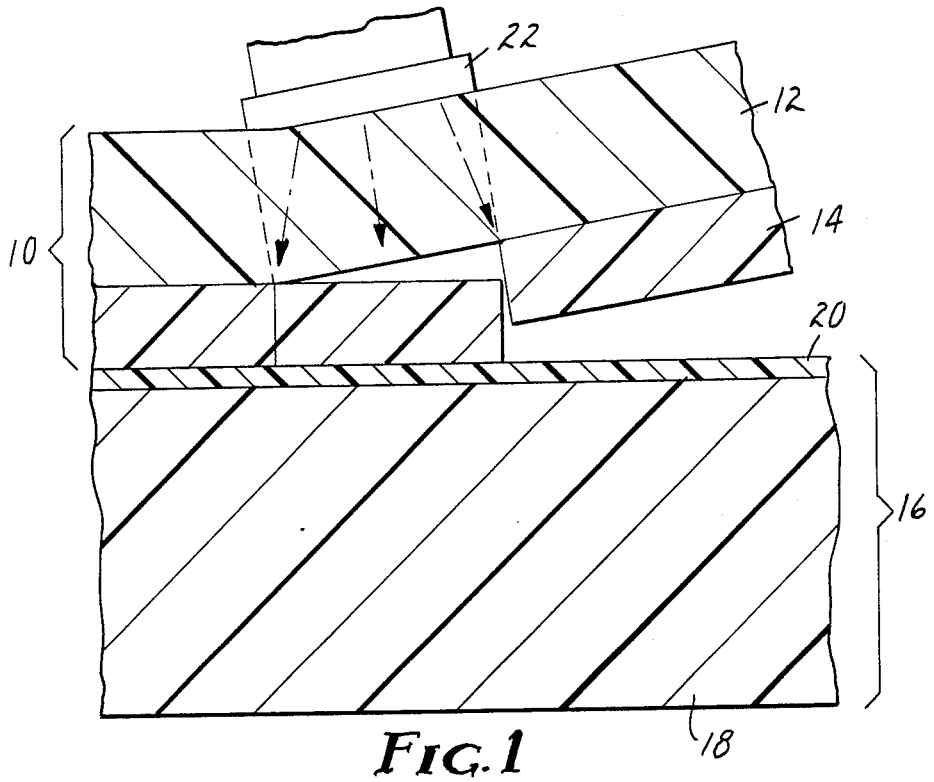
FIG. 1 is a schematic view of the thermal mass transfer printing process.

Referring now to FIG. 1, the donor sheet 10 comprises a backing 12 bearing a layer 14 of image donating material, or an ink transfer layer, on at least one major surface thereof. The receptor sheet 16 comprises a transparent backing 18 bearing a transparent layer 20 of image receptive material on at least one major surface thereof. As seen in FIG. 1, the heat which effects the image transfer is applied by printhead 22 through backing 12 of donor sheet 10, from which it must be conducted downward through backing 12 to image donating layer 14. Because such heat conduction requires a temperature drop, it is desirable to use the thinnest backing practicable in order to deliver the highest possible temperature to the image donating layer. The heat from a small area of printhead contact tends to spread out, so that if a small dot or thin line is to be printed, donor sheet 10 will be heated over a larger area, but to a lower temperature, if backing 12 is thicker. The lower limit of backing thickness is determined by considerations of mechanical strength and handleability. If polyethylene terephthalate (PET) film is used as the backing, thicknesses much below four micrometers are difficult to use and manufacture, have insufficient mechanical strength, and are generally not available. A typical donor sheet backing is six micrometers thick PET ("Mylar", E. I. du Pont de Nemours and Co.). Preferably, the caliper of donor sheet backings can range from about 4 to about 20 micrometers. Other polymeric materials that are suitable for backing 12 include, but are not limited to, polycarbonates, polyimides, polysulfones, polystyrenes, polyesters, polyolefins, polyvinyl chlorides, nitrocellulose, polyamides, polyacrylonitriles, cellulose acetate, and condenser paper (polymer-impregnated paper).

Image donating layer 14, or ink transfer layer, comprises a polymeric binder and at least one colorant, typically selected from dyes or finely dispersed pigments, and optionally, other modifiers. It is required that the polymeric binder for image donating layer 14 adhere to and be compatible with image receptive layer 20 of receptor sheet 16 in the imaged areas; accordingly the polymeric binder of image donating layer 14 and the polymeric binder of image receptive layer 20 must be selected as complementary pairs. Materials that are suitable for the binders of image donating layer 14 include, but are not limited to, copolymers of vinyl chloride and vinyl acetate, and copolymers of butadiene and styrene.

The properties of the image donating materials which are needed include (a) low haze, (b) appropriate color and color density, (c) capability of softening at appropriate elevated temperatures, (d) proper affinity for the image receptive layer at imaging temperatures, (e) limited adhesion to the backing of the donor sheet, (f) sufficiently low cohesive strength to allow satisfactory edge acuity of the image, (g) transparency. Colorants are preferably selected so as to provide the colors cyan, magenta, yellow, and black. Colorants that are suitable for the present invention include pigments, such as, for example, monoazo, disazo, and phthalocyanine pigments, and dyes, such as, for example, methine, monoazo, disazo, triarylmethane, xanthine (amino derivative), mono-oxazine, and indophenol dyes. Both dyes and pigments must be transparent when dispersed in the binder of the donor sheet.

As stated previously, receptor sheet 16 comprises a transparent backing 18 bearing a transparent image receptive layer 20 on at least one major surface thereof. Suitable materials for polymeric backing 18 include polyesters, e.g. polyethylene terephthalate, cellulose acetate, cellulose triacetate, polyolefins, polyvinyl chlorides, nitrocellulose, polyamides, polyvinylidene chlorides, polystyrenes, polysulfones, polycarbonates, and other flexible transparent polymeric films. The caliper of backing 18 can vary, and preferably ranges from about 50 to about 200 micrometers. The necessary properties of image receptive layer 20 are (a) low haze, (b) capability of softening at appropriate elevated temperatures, (c) strong adhesion to the backing of the receptor sheet, (d) transparency, (e) sufficient durability to be handled in the manner customary for such materials. Materials that are suitable for image receptive layer 20 include, but are not limited to, polyvinyl acetate, polyesters, poly-N-butyl methacrylate, and copolymers of vinyl chloride and vinyl acetate.

Image receptive layer 20 must be strongly bonded to backing 18 of receptor sheet 16, not only for durability of the imaged transparency, but also because the imaging process itself depends upon the adhesive and cohesive forces of image receptive layer 20 being able to draw image donating layer 14 away from donor sheet backing 12 in the imaged areas. An adhesion promoting layer, e.g. a layer of polyvinylidene chloride, can be used to more firmly adhere backing 18 to image receptive layer 20.

Image donating layer 14 and image receptive layer 20 may be applied to their respective backings by coating from solvent-based compositions, latex dispersions, hot-melt compositions, or other suitable compositions known to those skilled in the art. The methods of coating may include rotogravure, reverse roll, air knife, Mayer bar, and other suitable means.

While image donating layer 14 of donor sheet 10 and image receptive layer 20 of receptor sheet 18 must each exhibit certain individual thermal, optical, and mechanical properties, they must, at the same time, exhibit certain compatibility properties relative to one another. As mentioned previously, the polymeric binder materials of image donating layer 14 and image receptive layer 20 must each be of low optical haze, so as not to scatter light, which would result in dark, dull colors upon projection. The colorants, which can be either dyes or suitably dispersed pigments, must be compatible with the polymeric binder of image receptive layer 20 in the sense that the resulting images must exhibit low haze. Haze levels below 15% are considered acceptable for this invention. Image donating layer 14 must have rheological properties which allow it to detach completely from backing 12 in imaged areas but hold firmly to it in unimaged areas. Image donating layer 14 must have low tear strength in relation to its adhesive strength to backing 12 of donor sheet 10, in order to provide good edge acuity for the image.

The imagewise heat-activated adhesion between image donating layer 14 and image receptive layer 20 must be sufficiently great to draw image donating layer 14 away from backing 12 in the imaged areas, but sufficiently selective so as not to bring about release of image donating layer 14 in unimaged areas. By formulating image donating layer 14 and image receptive layer 20 such that at least one of them softens at the imaging temperature, and such that the surface energies of image donating layer 14 and image receptive layer 20 bear a suitable relation to one another, such adhesion can be made to occur. At the same time, both surfaces must be non-tacky and must not adhere at a temperature below the imaging temperature.

It has been found that in order for donor sheets 10 and receptor sheets 16 to perform satisfactorily in this invention, the softening temperatures of image donating layer 14 and image receptive layer 20 must fall within certain ranges, defined by the following rules:

1. The softening temperatures of both image donating layer 14 and image receptive layer 20 must be above about 60° C., so as to avoid unwanted imaging in non-imaged areas.
2. Either image donating layer 14 or image receptive layer 20 must have a softening temperature at or below 105° C.
3. If image donating layer 14 softens at or below 105° C., then image receptive layer 20 must soften below 185° C.
4. If image receptive layer 20 softens at or below 105° C., then image donating layer 14 must soften below 150° C.

Figure 2:
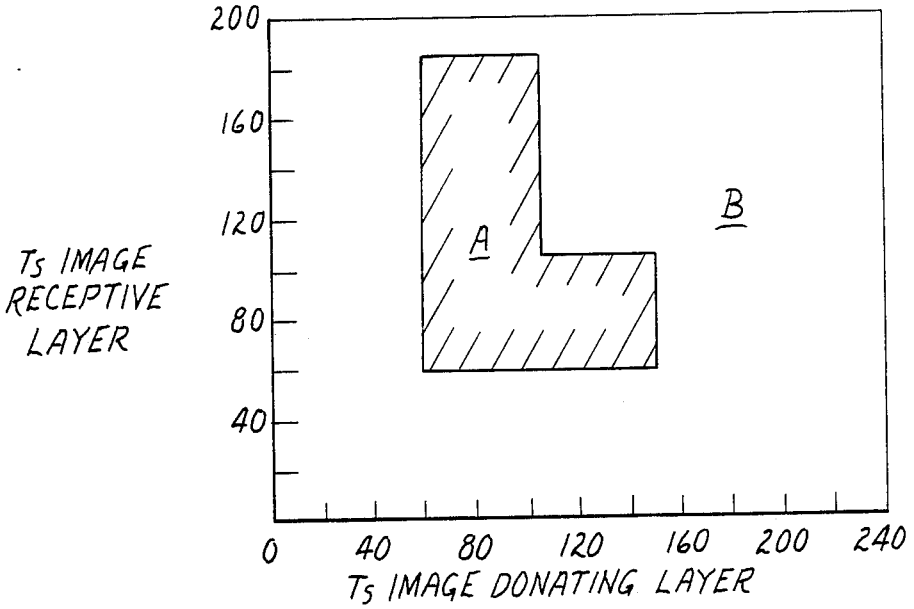
FIG. 2 is a diagram showing the relationship between the softening temperatures of the image donating layer and image receptive layer and thermal mass transfer imaging performance.

These rules are illustrated graphically in FIG. 2, where those materials which obey the above rules fall within the "satisfactory region," denoted by the letter A, and those which do not obey the rules fall into the "unsatisfactory region," denoted by the letter B. As used herein, the term "softening temperature" means the temperature determined by the THERMAL SOFTENING test, which is described hereinbelow.

In addition to the softening temperature defined above, it has been found that the glass transition temperature (Tg) of image receptive layer 20 must be equal to or less than 70° C. for satisfactory operation of this invention.

The selection of areas for transfer of material of image donating layer 14 is accomplished by thermal transfer, the heat being provided in an imagewise manner by a thermal printhead 22 of the type typically seen in thermal printing apparatus used for computer output, as described in the references cited previously.

Imagewise thermal transfer is effected by a conventional thermal printhead of the sort used in commercially available thermal transfer imaging devices, such as the Calcomp Colormaster (Calcomp, a Sanders Company, Anaheim, Calif. 92803). The operation of such a device is shown schematically in FIG. 1. Donor sheet 10 is placed into contact with receptor sheet 12 so that image donating layer 14 is in face-to-face contact with image receptive layer 20. Donor sheet 10 is heated in the areas from which donor material is to be transferred by contact with thermal printhead 22. The areas to be heated are selected by signals from a host computer or other suitable source of digital data, said signals being synchronized with the motion of the donor sheet 10-receptor sheet 16 combination relative to printhead 22. Depending on the mechanical details of the particular printing apparatus being used, this relative motion may be achieved by either moving the donor sheet 10-receptor sheet 16 combination relative to printhead 22, as is done in the Calcomp Colormaster, or by moving printhead 22 relative to the donor sheet 10-receptor sheet 16 combination. The mechanical arrangement of the printing apparatus is such that after printing, donor sheet 10 is pulled away from receptor sheet 16, leaving image donating material 14 on image receptive layer 20 of receptor sheet 16.

Considering the dullness and lack of color fidelity of images projected from transparencies made with conventional thermal mass transfer printing materials, it is surprising that projectable colors of the clarity and brightness found in the present invention could be achieved with conventional thermal printing apparatus, running at speeds comparable to those achieved in printing meltable wax compositions onto paper. Further, it is surprising that imagewise transfer of material from image donating layer 14 could occur without softening of said layer.

Color images produced by the materials described herein project with a much higher degree of clarity, brightness, and color fidelity than is presently attainable from conventional thermal mass transfer colored donor materials. Even though image donating layer 14 of donor sheet 10 is not required to undergo the melting previously considered necessary for attaining the printing speeds employed in commercially available digital thermal printers, imaging with these materials can still be carried out at printing speeds comparable to those reached in meltable wax-donor printing onto paper. Imagewise transfer of material from image donating layer 14 can proceed not only by softening of that layer, but may also proceed by softening of image receptive layer 20 only and not image donating layer 14, or by softening of both image donating layer 14 and image receptive layer 20.

The imageability of the donor sheet-receptor sheet samples was tested with a specially designed test apparatus consisting of a Hewlett-Packard thermal printhead (Part No. 07310-60050) having an addressability of 120 dots/inch. The mechanical arrangement pressed the printhead down onto the donor sheet-receptor sheet combination with a force of 593 grams. The donor sheet-receptor sheet combination was driven through the printer at a speed of 1.9 centimeters per second by means of an arrangement of power driven rubber rolls. The signal to drive the printhead was provided by a laboratory-designed microcomputer which delivered to the printhead a voltage which could be varied in the range of 4.0–8.0 volts, with a pulse width of 4.0 milliseconds. The microcomputer was able to generate either a solid area of printing or a pattern of individual dots.

The standard for comparison with existing thermal mass transfer materials was the wax-based donor sheet and accompanying receptor sheet provided commercially for the Calcomp Colormaster printer/plotter (Calcomp, A Sanders Company, Anaheim, Calif. 92803).

Evaluation of the previously mentioned properties was carried out in the following manner:

HAZE

Haze is measured with the Gardner Model XL-211 Hazeguard hazemeter or equivalent instrument. The procedure for performing this test is set forth in ASTM D 1003-61 (Reapproved 1977).

COLOR DENSITY

Color density is measured using a MacBeth TD504 transmission densitometer, equipped with status A filters (ANSI PH2.1-1952(R1969)). Measurements for the particular color under consideration were carried out by measuring the optical density of the sample with the complementary color filter in place, as follows: cyan sample:red filter, magenta sample:green filter, yellow sample:blue filter. Results were expressed in units of optical density. This test could be run either on donor sheets or upon imaged receptor sheets, provided that a sufficient area of solid imaging was available.

THERMAL SOFTENING

The softening temperature is measured by means of a Kofler Hotbench (Reichert-Jung Model #7841). The test of softening temperature is performed by grinding a quantity of the sample polymer to a fine powder and spreading it along the hotbench, so that it is exposed to the range of temperatures thereon. After three to five minutes, temperature regions of solid, semisolid, and liquid polymer sample appear, and the temperatures of these regions are measured and recorded. The lowest temperature in the semisolid range is taken to be the softening temperature of the polymer, and is denoted by Ts.

ADHESION OF IMAGE DONATING LAYER TO BACKING OF DONOR SHEET

The ability of the image donating layer to be removed from the donor sheet backing in the imaged areas but not in unimaged areas is dependent upon its degree of adhesion to the backing. A suitable test to determine the upper limit of adhesion is the tape test. A 1-in. length of ¾-in. wide Scotch ® Brand Magic Mending Tape (Minnesota Mining and Manufacturing Company) is pressed against the surface of the image donating layer in the manner described in ASTM D3359-76. The tape should be sufficiently long so that after this 1-in. length is applied, a sufficient length remains to act as a pull tab. This tab is then pulled at a 90° angle to the surface of the donor sheet. If at least 5% of the image donating layer comes off with the tape, the donor sheet is considered to be a good candidate for the thermal mass transfer system of this invention.

The lower limit of adhesion of image donating layer to donor sheet backing is tested by tightly wrapping the donor sheet around a 1-in. diameter cylindrical shaft with the backing side facing the shaft. If the image donating layer remains tightly adhered to the backing during this test, it is considered an acceptable candidate for thermal mass transfer imaging as described herein.

COHESIVE STRENGTH OF IMAGE DONATING LAYER

Cohesive strength is measured by means of the tape test described above. If the areas of image donating layer removal described in the tape test end sharply at the edge of the area of tape contact, without removing material in the untaped area, cohesive strength is considered to be sufficiently low so that the donor sheet is satisfactory.

ADHESION OF IMAGE RECEPTIVE LAYER TO BACKING OF RECEPTOR SHEET

Since imaging occurs as a result of the adhesive forces of the image receptive layer of the receptor sheet pulling image donating layer from the backing of the donor sheet, it is necessary that the coatings comprising the image receptive layer be strongly adhered to the backing of the receptor sheet. This adhesion value is determined by a Scotch ® tape test similar to that described above, except that in this case, for the image receptive layer to be satisfactory, it should remain on the backing, rather than be pulled off, as is the image donating layer of the donor sheet.

OVEN ADHESION

An additional test for determining whether or not a particular donor sheet-receptor sheet combination will provide adequate adhesion in the imaged areas is conducted by placing the two sheets in face-to-face contact in the manner that they would be used in a thermal printer. The two sheets are then placed, while still in contact, on a flat surface in an oven at 85° C. for two minutes. After this time, while still in the oven, the sheets are pressed into intimate contact by rolling a 10 kg. rubber roller over the donor sheet-receptor sheet composite five times. The sheets are then cooled, without separating, to room temperature. When peeled apart at an angle of 90°, at least 10% of the coating from the image donating layer of the donor sheet should have transferred to the image receptive layer of receptor sheet, in order for the donor sheet-receptor sheet combination to be considered acceptable.

The following examples illustrate the effects of the selection criteria specified earlier for the donor sheet and receptor sheet properties. The relation of the softening temperatures of the image donating layers and image receptive layers used in these examples to the specified rules is shown in FIG. 2.

Several general preparation techniques used in all of the examples will be described first, after which, examples of specific formulations will be described.

Compositions for preparing the image donating layers were prepared by dissolving the particular polymer being used in an appropriate solvent, and then dispersing the colorant into the resulting solution. The method of dispersal depended upon whether the colorant was a dye or a pigment. In the case of dyes, simple mixing, for example, by means of a motor driven propeller or similar means of stirring or agitation, was sufficient because the dyes were specifically chosen to be soluble in the polymer solution. The concentration of polymer in the solvent was chosen primarily on the basis of achieving the desired dry coating thickness.

In the case of pigment colorants, dispersal was by means of a bead mill consisting of a 500 ml stainless steel beaker partially filled with 3–4 mm diameter glass beads which were agitated by a 3-bladed propeller with pitch adjusted in such a way that it circulated the beads downward near the center of the beaker, from which they flowed outward along the bottom and recirculated upward at the walls of the beaker. Since the rotation of the propeller in the beaker of beads generated considerable torque, it was necessary to clamp the beaker firmly to a solid base. The rolling and rubbing action of the beads against one another, against the propeller, and against the walls of the beaker provided a very effective means of dispersing the pigment particles in the solution of polymeric binder. The number of glass beads added was chosen so that the level of polymer solution was just below the top of the beads. It was found necessary to use a relatively high concentration of polymer in the solvent to bring the viscosity of the solution to a sufficient level for pigment dispersion. Milling times were determined by coating out test samples of the solution that were run for various times on the bead mill, and observing the degree of transparency and brightness of color. Typical milling times were found to be in the range of about four to about seven hours, depending upon the particular polymer and pigment used.

Because the concentration of polymer required to achieve the viscosity necessary for proper pigment dispersion was considerably higher than that desired for coating, the solution was diluted with an amount of solvent sufficient to lower the concentration of polymer to the level needed for coating. This additional solvent was incorporated into the solution by further mixing in the bead mill. Finally, the solution was filtered through a disposable paint strainer consisting of a layer of cheesecloth mounted in a cardboard funnel, to remove the beads, and the solution was in condition for coating.

Donor sheets were prepared by coating the solution described above onto one surface of unprimed polyethylene terephthalate (hereinafter PET) film ("Mylar", E. I. du Pont de Nemours and Co.) of 6 micrometer caliper, by means of a Mayer rod. The coating was dried using a Dayton Model 2Z045 heat gun, taking care not to wrinkle the film by overheating. The resulting coating thickness ranged from 1.0 to 1.5 micrometers, depending upon solution concentration and Mayer rod used.

A release layer was applied to the opposite surface of the donor sheet in the form of a thin coating of silicone grease to prevent the backing of the donor sheet from sticking to the printhead during operation. The silicone coating was prepared by dissolving Dow-Corning high-vacuum grease to a 0.1% concentration by weight in hexane, and applying it with a cotton swab. The entire donor sheet was given a final oven drying at 85° C. for two minutes.

The following, non-limiting examples further illustrate the present invention.

EXAMPLE 1

A coating solution for the image donating layer for the donor sheet was prepared by dissolving 24 grams of a copolymer of vinyl acetate and vinyl chloride (VYES, Union Carbide Corp., Ts=80° C.) in a solvent blend consisting of 57.6 grams of methyl-ethyl ketone and 14.4 grams of toluene. To this solution was added 4 grams of cyan pigment (Sunfast Blue #249-1282, Sun Chemical Corp.). This mixture was bead-milled for four hours in the apparatus described previously. The concentration desired for coating was achieved by adding 80 grams of methyl-ethyl ketone and 20 grams of toluene to this mixture and mixing further. The blend was then filtered by means of a disposable paint strainer. The filtered solution of image donating composition was coated onto one surface of 6 micrometer unprimed PET ("Mylar") by means of a #9 Mayer rod.

A coating solution of the image receptive layer for the receptor sheet was prepared by dissolving 10 grams of polyvinyl acetate ("Vinac B-15", Air Products and Chemicals, Inc., Tg=27° C., Ts=136° C.) in 90 grams of a blend of equal parts by weight of methyl-ethyl ketone and toluene. This solution was coated onto 4 mil polyvinylidene chloride (PVDC) primed PET film using a #9 Mayer rod and oven dried at 85° C. for two minutes.

When the oven adhesion test was run on this donor sheet-receptor sheet pair, transfer of image donating layer did occur. Testing with the Hewlett-Packard thermal printhead described above, at various voltages, showed that above 7.0 volts, imaging was complete, and optical density, measured on the MacBeth TD504 densitometer, using the Status A red filter, was 1.2. Haze was 7%. By comparison, the optical density provided by a sample of a Calcomp cyan donor sheet, imaged on the Calcomp receptor sheet, was 0.9, with a haze of 8.1%. The donor sheet-receptor sheet pair of this invention provided higher optical density and lower haze than that of the best competitor. Moreover, images made using the donor sheet and receptor sheet described above were permanently bonded to the receptor sheet, in that they could not be scratched off with a fingernail.

EXAMPLE 2

A donor sheet was prepared as in Example 1. The coating solution for the image receptive layer of the receptor sheet was prepared by dissolving 10 grams of VYES copolymer in a blend of 72 grams of methyl-ethyl ketone and 18 grams of toluene. The solution was coated onto 4 mil PVDC primed PET backing in the manner described in Example 1.

The oven adhesion test indicated good transfer from donor sheet to receptor sheet, and the Ts and Tg for this receptor sheet were within the ranges prescribed by the rules stated previously. Testing on the thermal printing test apparatus showed that imaging was satisfactory.

EXAMPLE 3

A donor sheet was prepared as in Example 1, except that a lighter coating was applied, by means of a #6, rather than a #9, Mayer rod. The image receptive layer of the receptor sheet was prepared by coating a solution of 10 grams of soluble polyester ("Vitel VPE-5833A", The Goodyear Tire and Rubber Co., Tg=48° C., Ts=82° C.) dissolved in 90 grams of methyl-ethyl ketone onto 4 mil PVDC primed PET backing, using a #9 Mayer rod, and drying for two minutes at 85° C. Ts for the image donating layer and image receptive layer were within the ranges prescribed by the rules stated previously. The oven adhesion test showed good transfer of the image donating layer to the image receptive layer.

These sheets were tested with the thermal printing test apparatus as in Example 1, and performance was equivalent to that of the sheets prepared in Example 1.

EXAMPLE 4

A cyan coating solution for the image donating layer was prepared by dissolving 14.4 grams of styrene-butadiene copolymer ("Pliolite S5E", The Goodyear Tire and Rubber Co., Tg=50° C., Ts=105° C.) in 81.6 grams of toluene. This solution, along with 4 grams of cyan pigment (Sunfast Blue #249-1282, Sun Chemical Company), was bead-milled for four hours. A concentration suitable for coating was obtained by adding 50 grams of toluene, after which the mixture was mixed further. The solution was coated onto 6 micrometer unprimed PET backing by means of a #6 Mayer rod.

When this donor sheet was used with the receptor sheet prepared in Example 3, the oven adhesion test indicated good transfer. Testing on the thermal printing test apparatus showed that imaging was satisfactory.

EXAMPLE 5

A magenta coating solution for the image donating layer was prepared by dissolving 24 grams of a copolymer of vinyl acetate and vinyl chloride (VYES, Union Carbide Corp., Ts=80° C.) in a solvent blend consisting of 57.6 grams of methyl-ethyl ketone and 14.4 grams of toluene. To this solution was added 4 grams of magenta pigment (National Red #219-3505, Sun Chemical Corp.). This mixture was bead-milled for six hours in the apparatus described previously. The final concentration required for coating was achieved by adding 80 grams of methyl-ethyl ketone and 20 grams of toluene to the mixture and milling further. The blend was then filtered by being passed through a disposable paint strainer. The filtered solution was coated onto 6 micrometer PET backing by means of a #6 Mayer rod and dried. This donor sheet was used with the receptor sheet prepared in Example 1.

The oven adhesion test indicated good transfer from donor sheet to receptor sheet. Imaging on the thermal printing test apparatus was satisfactory with image haze being 10%. Optical density, measured using the Status A green filter, was 0.7, and the images could not be scraped off with a fingernail. By comparison, the optical density of a Calcomp receptor sheet imaged by a Calcomp magenta donor sheet was 0.6, with a haze of 18%.

EXAMPLE 6

A donor sheet was prepared using a yellow pigment (Lemon Metallic Yellow #275-0562, Sun Chemical Corp.) and the binder described in Example 5. Bead-milling time was seven hours. The oven adhesion test indicated good transfer. The receptor sheet used in Example 1 was printed with the donor sheet of this example.-Haze was 13%, and optical density was 0.6, measured through a Status A blue filter. By comparison, the Calcomp yellow donor sheet upon transfer to the Calcomp receptor sheet gave a haze of 23%, and an optical density of 0.4, measured through a Status A blue filter.

EXAMPLE 7

A cyan donor sheet utilizing dye instead of pigment was prepared by first dissolving 0.1 gram of VYES copolymer in a blend of 0.72 gram of methyl-ethyl ketone and 0.18 gram of toluene. To this solution was added a solution consisting of 30 milligrams of 2-chloro-2'-methyl-N,N-diethylindoaniline dye dissolved in 470 milligrams of a blend of methyl-ethyl ketone and toluene. The combined solution was mixed and coated onto 6 micrometer PET backing using a #9 Mayer rod.

The receptor sheet described in Example 3 was printed with the donor sheet of this example and the resulting image haze was 5.5%. The optical density, measured through a Status A red filter, was 1.4. The images could not be removed by scratching with a fingernail.

EXAMPLE 8

A receptor sheet was prepared by dissolving 10 grams of poly-N-butyl methacrylate ("Elvacite 2044", E. I. du Pont de Nemours and Co., Tg=15° C., Ts=154° C.) in 90 grams of a blend of methyl-ethyl ketone and toluene, and coating the resulting solution a onto 4 mil PVDC primed PET backing. When this receptor sheet was used with the donor sheet prepared in Example 4, the oven adhesion test indicated good transfer, and the Tg of the image receptive layer was well below the 70° C. limit prescribed above. However, since the softening temperature of the image donating layer (105° C.) was at its upper limit, and the softening temperature of the image receptive layer (154° C.) was somewhat nearer to its upper limit than some of the other formulations described herein, it was expected that image quality might be somewhat reduced. It was found that printing with the thermal test apparatus indicated that image transfer was somewhat less than complete. This example illustrates the gradual nature of the transition between satisfactory donor sheet-receptor sheet combinations and unsatisfactory ones.

EXAMPLE 9

A receptor sheet was prepared by dissolving 10 grams of styrene-butadiene copolymer ("Pliolite S5E", The Goodyear Tire and Rubber Co., Tg=50° C., Ts=105° C.) in 90 grams of toluene, and coating this solution onto 4 mil PVDC primed PET backing. The donor sheet was the same as that used in Example 1. The oven adhesion test indicated no transfer. Tests of this material on the thermal printing test apparatus showed that the pair did not image, thereby demonstrating that this was an unsatisfactory combination of donor sheet and receptor sheet.

EXAMPLE 10

A receptor sheet was prepared by dissolving 10 grams of a copolymer of styrene and acrylonitrile ("Tyril 1000", The Dow Chemical Co., Tg=98° C.) in 90 grams of a blend of equal parts by weight of methyl-ethyl ketone and toluene, and coating this solution onto 4 mil PVDC primed PET backing. The Tg of the image receptive layer was well above the 70° C. permitted by the rules described previously. The donor sheet was the same as that used in Example 1. The images were of extremely low optical density, and were not satisfactory.

EXAMPLE 11

A receptor sheet coating was prepared by dissolving 1.5 grams of ethyl cellulose (N100, Hercules Inc., Tg=40° C., Ts=195° C.) in 98.5 grams of toluene, and coating this solution onto 4 mil PVDC primed PET backing. The donor sheet was the same as that used in Example 1. This combination failed the oven adhesion test. Printing in the thermal printing test apparatus indicated that this receptor sheet would not produce satisfactory images.

EXAMPLE 12

A donor sheet was prepared by dissolving 1.5 grams of ethyl cellulose (N100, Hercules, Inc.) in 97.5 grams of toluene. To this solution was added 1.0 gram of Sunfast Blue #249-1282 (Sun Chemical Corp.). This mixture was bead-milled for 4 hours, after which 15 grams of toluene was added, followed by further mixing and filtering to remove the beads. This solution was coated onto 6 micrometer PET backing as described previously.

A receptor sheet was prepared by dissolving 10 grams of vinyl chloride-vinyl acetate copolymer (VYES, Union Carbide Corp. in a blend of 72 grams of methyl-ethyl ketone and 18 grams of toluene. This solution was coated onto 4 mil PVDC primed polyester backing in the manner described previously.

In this case, the Ts of the donor was above the maximum value permitted by the rules stated previously. The Ts and Tg for the receptor sheet were within the ranges prescribed by the rules. Image quality was unsatisfactory.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Kit for preparing transparency films comprising:

(A) a donor sheet comprising a backing bearing on at least one major surface thereof a wax-free image donating layer comprising a binder and colorant, and (B) a receptor sheet comprising a transparent backing bearing on at least one major surface thereof a transparent image receptive layer comprising a polymeric binder having a glass transition temperature equal to or less than 70° C., said colorant being compatible with said polymeric binder such that images resulting from said kit exhibit a haze level below 15%, the softening temperature of each of said image donating layer and said image receptive layer being greater than 60° C., one of said image donating layer or said image receptive layer having a softening temperature below 105° C., provided that if said image donating layer has a softening temperature below 105° C., said image receptive layer must have a softening temperature below 185° C., and if said image receptive layer has a softening temperature below 105° C., said image donating layer must have a softening temperature below 150° C.

2. Kit according to claim 1 wherein the backing of said donor sheet is selected from the group consisting of polyesters, polyolefins, polyimides, polyvinyl chlorides, nitrocellulose, polyamides, polyacrylonitriles, cellulose acetate, polycarbonates, polystyrenes, polysulfones, and condenser paper.

3. Kit according to claim 1 wherein the backing of said donor sheet comprises polyethylene terephthalate.

4. Kit according to claim 1 wherein the caliper of said donor sheet backing ranges from about 4 to about 20 micrometers.

5. Kit according to claim 1 wherein the binder for said image donating layer is selected from the group consisting of copolymers of vinyl chloride and vinyl acetate, and copolymers of butadiene and styrene.

6. Kit according to claim 1 wherein said colorant is selected from the group consisting of monoazo, disazo, and phthalocyanine pigments which exhibit transparency when dispersed in said donor binder.

7. Kit according to claim 1 wherein said colorant is selected from the group consisting of methine, monoazo, disazo, triarylmethane, xanthene(amino derivative), mono-oxazine, and indophenol dyes which exhibit transparency when dispersed in said donor binder.

8. Kit according to claim 1 wherein the color of said colorant is selected from the group consisting of cyan, magenta, yellow, and black.

9. Kit according to claim 1 wherein a release layer is applied to the major surface of said backing opposite to the major surface thereof bearing the image donating layer.

10. Kit according to claim 1 wherein the backing of said receptor sheet is selected from the group consisting of polyester, cellulose acetate, cellulose triacetate, polyolefin, polyvinyl chloride, nitrocellulose, polyamide, polyvinylidene chloride, polycarbonate, polysulfone, and polystyrene.

11. Kit according to claim 1 wherein the backing of said receptor sheet comprises polyethylene terephthalate.

12. Kit according to claim 1 wherein said image receptive layer is selected from the group consisting of polyvinyl acetate, polyester, poly-N-butyl methacrylate, and copolymers of vinyl chloride and vinyl acetate.

13. Kit according to claim 1 wherein an adhesion promoting layer is disposed between said image receptive layer and said receptor backing.

14. Kit according to claim 14 wherein said adhesion promoting layer comprises polyvinylidene chloride.

15. Kit according to claim 1 wherein the caliper of said backing of said receptor sheet ranges from about 50 to about 200 micrometers.

* * * * *